US006936777B1

(12) United States Patent
Kawakubo

(10) Patent No.: US 6,936,777 B1
(45) Date of Patent: Aug. 30, 2005

(54) TWO-STEP SWITCH

(75) Inventor: Noboru Kawakubo, Shizuoka (JP)

(73) Assignee: Fuji Electronics Industries Co., Ltd., Shizuoka (JP)

( * ) Notice: Subject to any disclaimer, the term of this patent is extended or adjusted under 35 U.S.C. 154(b) by 0 days.

(21) Appl. No.: 10/942,853

(22) Filed: Sep. 17, 2004

(30) Foreign Application Priority Data

Mar. 12, 2004 (JP) ..... 2004-070163
Apr. 26, 2004 (JP) ..... 2004-129639
Aug. 16, 2004 (JP) ..... 2004-236359

(51) Int. Cl.[7] ..... H01H 5/30
(52) U.S. Cl. ..... 200/1 B; 200/406; 200/516
(58) Field of Search ..... 200/1 B, 406, 200/516

(56) References Cited

U.S. PATENT DOCUMENTS 4,359,614 A * 11/1982 Green et al. ..... 200/1 B
4,659,881 A * 4/1987 Dowe ..... 200/516
5,313,027 A * 5/1994 Inoue et al. ..... 200/1 B
5,510,584 A * 4/1996 Norris ..... 200/1 B
5,898,147 A * 4/1999 Domzalski et al. ..... 200/1 B
6,639,159 B2 * 10/2003 Anzai ..... 200/1 B
6,747,218 B2 * 6/2004 Huseman et al. ..... 200/1 B
6,784,382 B2 * 8/2004 Yanai et al. ..... 200/1 B
6,809,272 B2 * 10/2004 Yamada ..... 200/1 B

FOREIGN PATENT DOCUMENTS

JP 2002-163952 6/2002
JP 2002-352664 12/2002

* cited by examiner

*Primary Examiner*—Michael A. Friedhofer
(74) *Attorney, Agent, or Firm*—McGinn & Gibb, PLLC

(57) ABSTRACT

A two-step switch, which may be minimized in radial direction and is suitable for PCB or FPC circuit board, has a first contact spring, having outer peripheral contacts in regular contact with first fixed contacts and having an inner contact inside the outer peripheral contacts and reversed by depressing, and a second contact spring, stacked on the first contact spring via an insulation sheet, having an outer peripheral contact in regular contact with a second fixed contact and having an inner contact inside of the outer peripheral contact and reversed by depressing. Through a first depressing, the inner contact of the first contact spring is reversed and in contact with the inner contact of the second contact spring, whereby a first electric circuit is actuated. Also through a second depressing, the inner contact of the second contact spring is reversed and in contact with the third fixed contact, whereby a second electric circuit is actuated.

20 Claims, 12 Drawing Sheets

TWO-STEP SWITCH

BACKGROUND OF THE INVENTION

1. Field of the Invention

The present invention relates to a two-step electric switch which actuates two switching circuits sequentially, by two-step depressing operation. More particularly, the present invention relates to the two-step electric switch which can be used for printed circuit board effectively because of improved switch contact springs.

2. Description of the Related Art

There are several disclosures regarding this type of two-step switch, for example, patent documents 1 and 2, as follows:

Patent Document 1: Official Gazette of Japanese Unexamined Patent Publication No. 2002-352664; and Patent Document 2: Official Gazette of Japanese Unexamined Patent Publication No. 2002-163952.

FIG. 18 shows a structure of a two-step switch according to the Patent Document 1. FIG. 18 is a perspective view of a switch contact spring 201, having a center disk 203, a ring frame 205 positioned along the outer periphery center ring 203, connecting chips 207, 207 connecting the center disk 203 to the ring frame 205, and supporting chips 209, 209 provided on the outer periphery of the ring frame 205.

There is a first movable contact on the outer periphery of the lower surface of the center disk 203. There is also a second movable contact on the lower surface of the center of the center disk 203. A regular contact is provided on the lower surface of the ring frame 205. On the other hand, there is an insulation housing (not shown) under the switch contact spring 201, on which a common contact, a first selective contact and a second selective contact are provided in this order from the outer periphery of the switch contact spring 201.

According to the above structure, the regular contact of the switch contact spring 201 is regularly in contact with the common contact. When a first click operation is done, the first movable contact of the switch contact spring 201 becomes in contact with the first selective contact, whereby a first electric circuit is provided. Then, when a second click operation is done, the second movable contact of the switch contact spring 201 becomes in contact with the second selective contact, whereby a second electric circuit is provided.

However, the conventional two-step switch according to the above disclosure has several disadvantageous points.

First, as illustrated in FIG. 18, the switch contact spring 201 according to the prior art has a dual structure in radial direction, i.e. the structure in which the ring frame 205 is positioned along the outer periphery of the center disk 203. Consequently, the size of switch would become larger in radial direction, and it is impossible to provide a small-size two-step switch.

For reference, as long as the present invention concerns, "small-size" means, for example, various two-step switches incorporated in narrow spaces, such as for portable telephones, etc.

Second, according to the two-step switch of the prior art, for the purpose of securing the (depressing) stroke, different levels should be provided on the fixed contacts in perpendicular direction. In particular, the different levels are provided among the common contact, the first selective contact and the second selective contact of the insulation housing, so that the necessary stroke may be secured. However, it is very difficult to provide such different levels on a printed circuit board, hence, the switch contact spring 201 according to the prior art cannot be used by simply making in contact with the printed circuit board.

Third, when the conventional switch is used for the printed circuit board, the switch contact spring 201 must be soldered, thus the switch should be made of any durable material against high temperature, which would increase the production cost.

Fourth, according to the switch contact spring 201 as shown in FIG. 18, two different loading characteristics must be provided by the single contact spring, which would require difficult adjustment working, having poor flexibility to be applied to various specifications.

SUMMARY OF THE INVENTION

It is an object of the present invention to provide a two-step switch, which can be minimized by preventing the increase of size in radial direction. Further, it is another object of the present invention to provide the two-step switch which can be used for printed circuit board easily.

To achieve the object mentioned above, according to claim 1 of the present invention, there is provided a two-step switch, comprising: a circuit board having first fixed contacts, a second fixed contact and a third fixed contact; a first contact spring, having outer peripheral contacts which are in regular contact with the first fixed contacts of the circuit board, and also having an inner contact which is positioned inside of the outer peripheral contacts and is reversed by depressing operation; and a second contact spring, stacked on the first contact spring via a first insulation sheet, having an outer peripheral contact which is in regular contact with the second fixed contact of the circuit board, and also having an inner contact which is positioned inside of the outer peripheral contact and is reversed by depressing operation, characterized in that: the inner contact of the first contact spring is reversed by a first depressing operation, and becomes in contact with the inner contact of the second contact spring, whereby a first electric circuit is actuated; and the inner contact of the second contact spring is reversed by a further second depressing operation, and becomes in contact with the third fixed contact of the circuit board, whereby a second electric circuit is actuated.

According to claim 2 of the present invention, there is provided the two-step switch as claimed in claim 1, further characterized in that: the first insulation sheet has an inner opening and outer openings, whereby the inner contact of the first contact spring becomes in contact with the inner contact of the second contact spring via the inner opening, and the outer peripheral contacts of the first contact spring are in contact with the first fixed contacts via the outer openings.

According to claim 3 of the present invention, there is provided the two-step switch as claimed in claim 1, further characterized in that: the first contact spring is in a dome shape, of which both ends of outer peripheral parts opposing to each other serve as the outer peripheral contacts, and of which protruding part having the inner contact has been formed in a bridge shape with having openings formed on both sides, and the both ends of outer peripheral parts have been formed in bowing shapes toward the opposite side of the protruding part.

According to claim 4 of the present invention, there is provided the two-step switch as claimed in claim 3, further characterized in that: the both ends of outer peripheral parts have projecting chips formed and projecting in radial direction and toward the opposite side of the protruding part, and the projecting chips serve as the outer peripheral contacts.

According to claim 5 of the present invention, there is provided the two-step switch as claimed in claim 1, further characterized in that: the second contact spring is in a dome shape, of which outer peripheral part serves as the outer peripheral contact, and of which protruding part serves as the inner contact.

According to claim 6 of the present invention, there is provided the two-step switch as claimed in claim 1, further comprising: a second insulation sheet between the second contact spring and the circuit board.

According to claim 7 of the present invention, there is provided the two-step switch as claimed in claim 6, further characterized in that: the second insulation sheet has an inner opening and outer openings, whereby the outer peripheral contact of the second contact spring becomes in contact with the second fixed contact of the circuit board via the inner opening, and the outer peripheral contacts of the first contact spring are in contact with the first fixed contacts via the outer openings.

According to claim 8 of the present invention, there is provided the two-step switch as claimed in any one claim of claims 1 through 7, further characterized in that: the first contact spring is covered by a cover film via a spacer.

According to claim 9 of the present invention, there is provided the two-step switch as claimed in any one claim of claims 1 through 8, further characterized in that: the two-step switch is mounted on a circuit board of various electric and electronic instruments and apparatus.

According to claim 10 of the present invention, there is provided the two-step switch as claimed in any one claim of claims 1 through 8, further characterized in that: the two-step switch is mounted on a circuit board of a portable telephone.

As discussed above, the two-step switch according to the present invention has the circuit board, having the first fixed contacts, the second fixed contact and the third fixed contact, the first contact spring, having the outer peripheral contacts in regular contact with the first fixed contacts of the circuit board, and also having the inner contact positioned inside of the outer peripheral contacts and is reversed by depressing operation, and the second contact spring, stacked on the first contact spring via the first insulation sheet, having the outer peripheral contact in regular contact with the second fixed contact of the circuit board, and also having the inner contact positioned inside of the outer peripheral contact and is reversed by depressing operation. Since the first contact spring and the second contact spring are stacked, the size in radial direction may be reduced, whereby it is possible to incorporate in a narrow space.

In particular, with reference to a portable telephone as an example, the thickness has been reduced, thus the size of the side surface should be minimized. As the size in radial direction of the two-step switch according to the prior art is large, it is quite difficult to incorporate the conventional two-step switch in such a narrow space. On the other hand, according to the two-step switch of the present invention, because the size in radial direction is reduced, it is possible to be incorporated in such a narrow space easily.

The first contact spring and the second contact spring are provided separately. Thus, it is not necessary to provide, likewise the case of the prior art, two different loading characteristics by a single contact spring. Therefore, the complicated adjustment working is no more required.

Preferably, the first contact spring may be in a dome shape, of which both ends of outer peripheral parts, opposing to each other, serve as the outer peripheral contacts, and of which protruding part having the inner contact has been formed in a bridge shape with having the openings formed on the both sides, and the both ends of outer peripheral parts have been formed in bowing shapes toward the opposite side of the protruding part. With this structure, it is possible to secure the height, i.e., the stroke, whereby the different levels are no more required on the fixed contacts, and it is possible to cope with various printed circuit boards.

Preferably, the both ends of outer peripheral parts may have the projecting chips formed and projecting in radial direction and toward the opposite side of the protruding part, and the projecting chips serve as the outer peripheral contacts. With this structure, the above effect may be further improved.

Preferably, the first contact spring may be covered by the cover film via the spacer. With this structure, the cover film may serve as the dust prevention cover.

Preferably, the two-step switch may be mounted on a circuit board of various electric and electronic instruments and apparatus, and on a circuit board of a portable telephone. With these structures, the above effect may be further improved.

BRIEF DESCRIPTION OF THE DRAWINGS

The invention will be described below in detail with reference to the accompanying drawings, in which.

DETAILED DESCRIPTION OF THE INVENTION

First Embodiment

Figure 1:
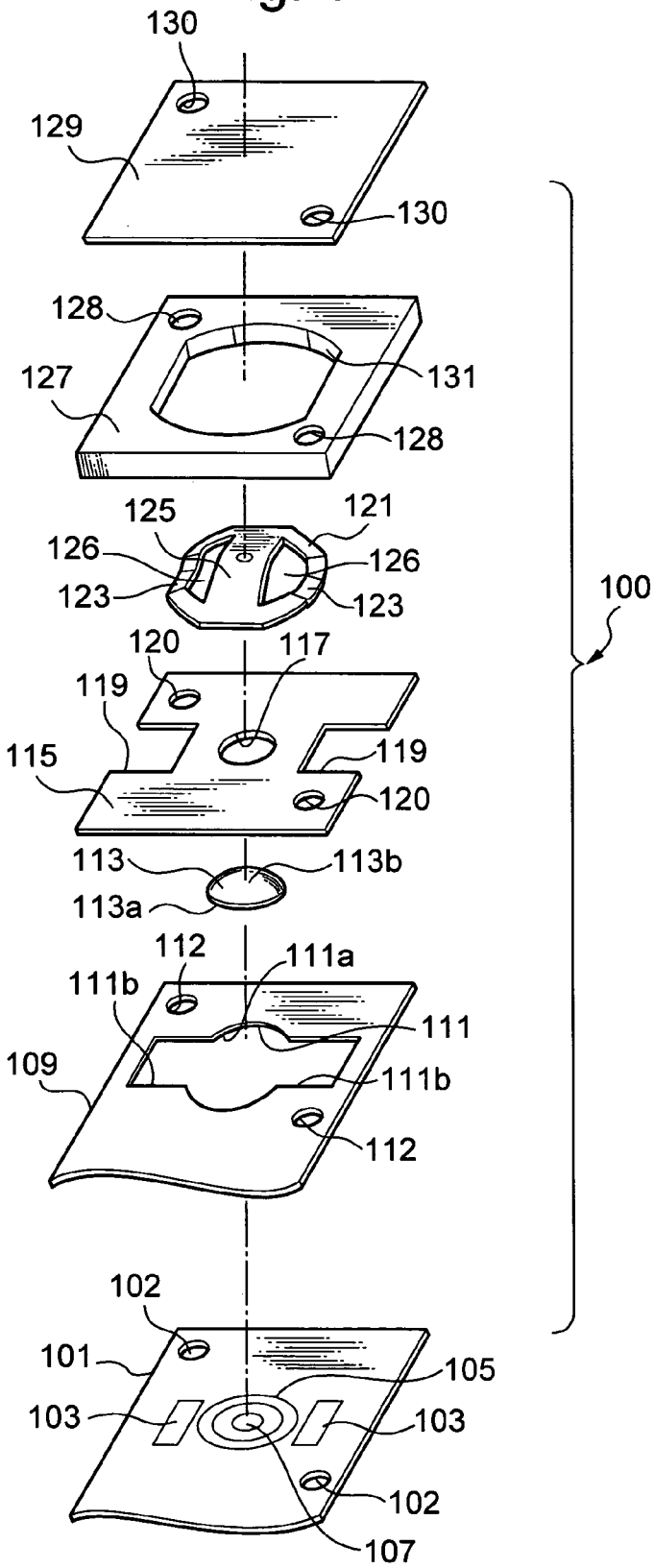
FIG. 1 is an exploded perspective view showing a structure of a two-step switch according to a first embodiment of the present invention.
Figure 2:
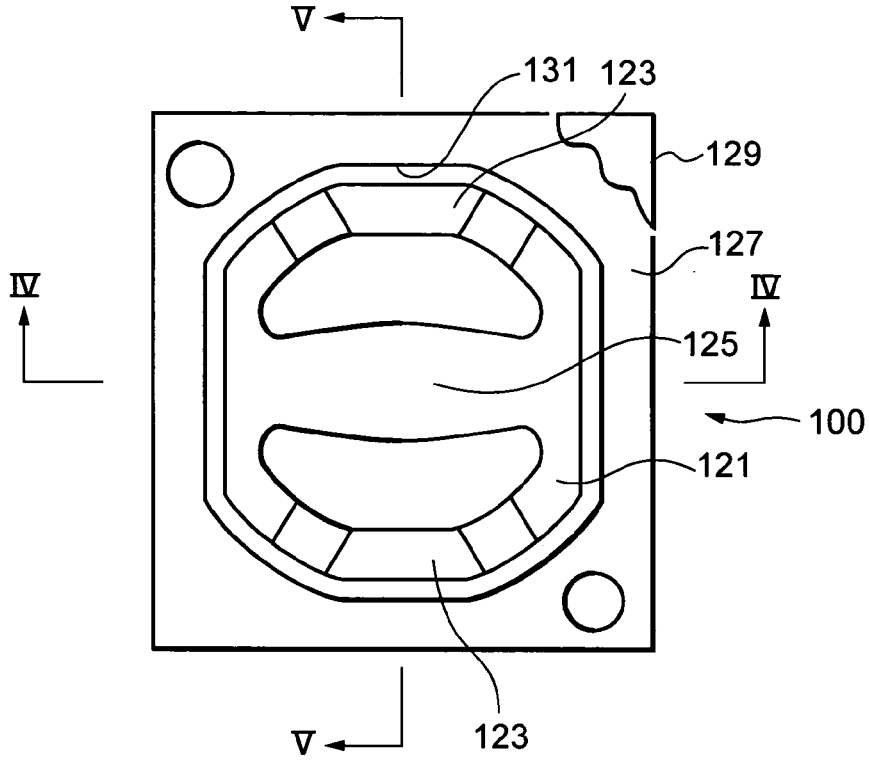
FIG. 2 is a plan view of the two-step switch according to the first embodiment of the present invention, in which a cover film has been removed partially.

A first embodiment of the present invention will now be described with reference to FIGS. 1 through 9. FIG. 1 is an exploded perspective view of a two-step switch 100 according to the first embodiment, FIG. 2 is a plan view of the two-step switch 100, FIG. 3 is a plan view of a printed circuit board, FIG. 4 is a sectional view as seen by the line IV—IV of FIG. 2, and FIG. 5 is a sectional view as seen by the line V—V of FIG. 2.

Figure 3:
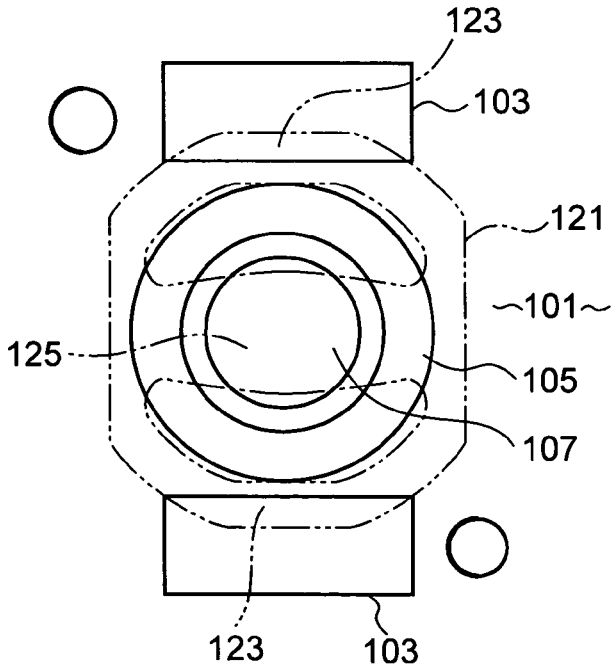
FIG. 3 is a plan vies of the two-step switch according to the first embodiment of the present invention, showing a position relation between fixed contacts of a circuit board and a first contact spring.

As illustrated in FIGS. 1 and 3, there is a printed circuit board 101, on which, first fixed contacts 103, a second fixed contact 105, and a third fixed contact 107, are provided. The printed circuit board 101 has penetrating holes 102, 102, at positions diametrically opposite to each other, into which fixing screws (not shown) are inserted respectively.

Figure 4:
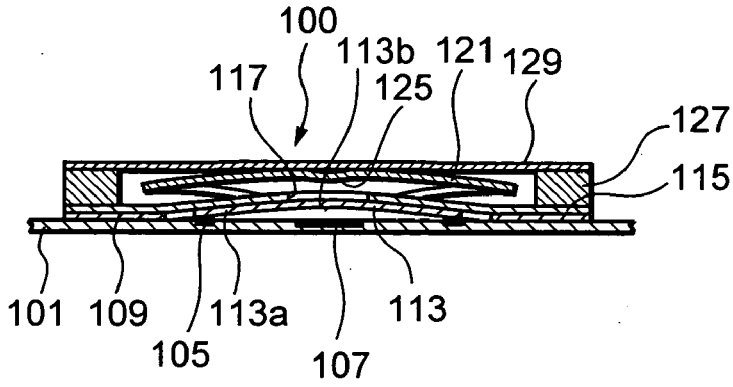
FIG. 4 is a sectional view as seen by the line IV—IV of FIG. 2 according to the first embodiment of the present invention.
Figure 5:
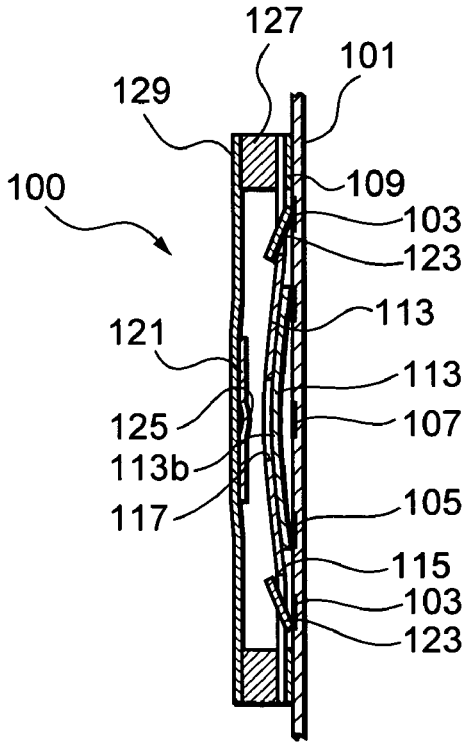
FIG. 5 is a sectional view as seen by the line V—V of FIG. 2 according to the first embodiment of the present invention.

Further, as illustrated in FIGS. 1, 4 and 5, there is an adhesive sheet 109, serving as a second insulation sheet, positioned above the printed circuit board 101. The adhesive sheet 109 has an opening 111. The opening 111 comprises, a circular opening 111*a* at the center thereof, and a pair of rectangular openings 111*b*, 111*b* continuously formed at the outer part of the circular opening 111*a*. The adhesive sheet 109 also has penetrating holes 112, 112, at positions diametrically opposite to each other, into which the fixing screws (not shown) are inserted respectively.

Figure 6A:
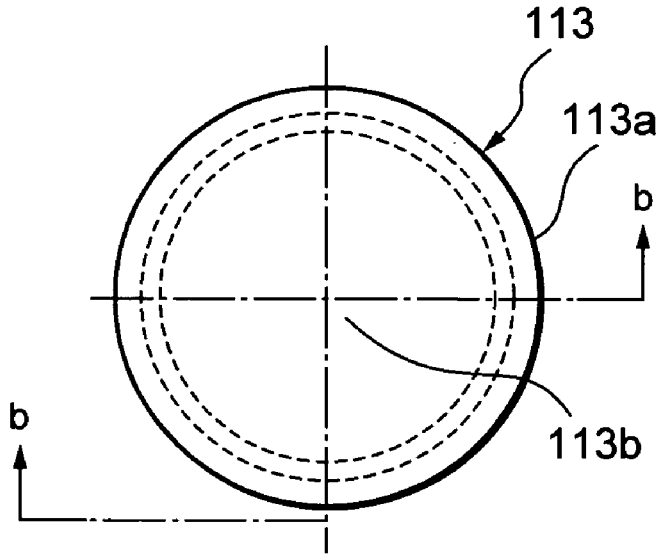
FIG. 6 has views showing the first embodiment of the present invention, in which, FIG. 6(*a*) is a plan view of a second contact spring, and FIG. 6(*b*) is a sectional view as seen by the lines b—b of FIG. 6(*a*)
Figure 6B:
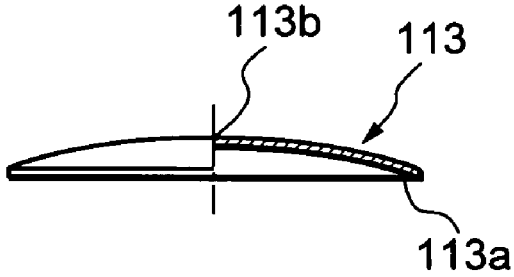

As illustrated in FIGS. 1, 4 and 5, there is a second contact spring 113, at the position of the circular opening 111*a* of the opening 111 of the adhesive sheet 109. As also illustrated in FIG. 6, the second contact spring 113 is in a dome shape, protruding in the upward direction of FIG. 1. The second contact spring 113 has an outer peripheral contact 113*a* at the outer periphery, and also has an inner contact 113*b* at the inner part. As illustrated in FIGS. 4 and 5, the outer peripheral contact 113*a* of the second contact spring 113 is in regular contact with the second contact 105 of the circuit board 101.

As illustrated in FIGS. 1, 4 and 5, there is also an adhesive sheet 115, serving as a first insulation sheet, positioned above the second contact spring 113. The adhesive sheet 115 has a circular opening 117 at the center thereof. There is also a pair of rectangular openings 119, 119, respectively formed on the right and left sides of the adhesive sheet 115, with having the circular opening 117 at the center thereof. The adhesive sheet 115 also has penetrating holes 120, 120, at positions diametrically opposite to each other, into which the fixing screws (not shown) are inserted respectively.

Figure 7A:
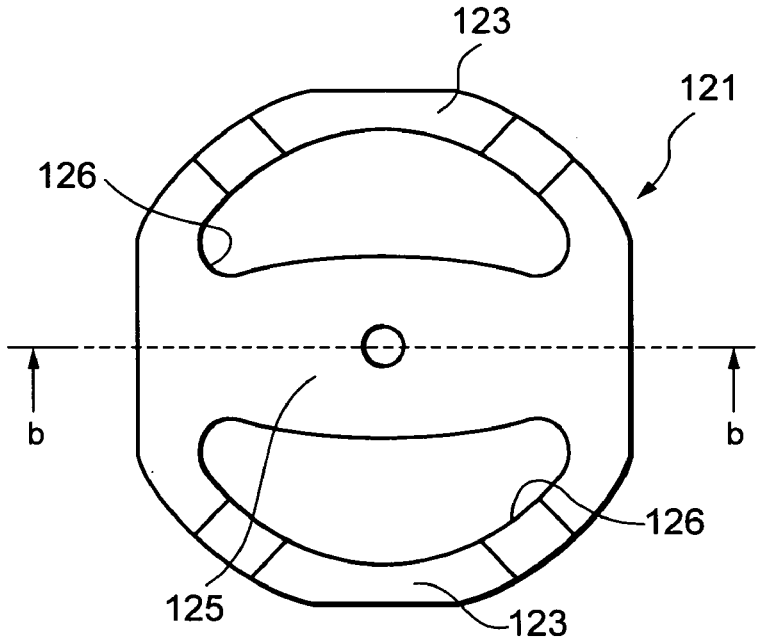
FIG. 7 has views showing the first embodiment of the present invention, in which, FIG. 7(*a*) is a plan view of the first contact spring, and FIG. 7(*b*) is a sectional view as seen by the line b—b of FIG. 7(*a*)
Figure 7B:
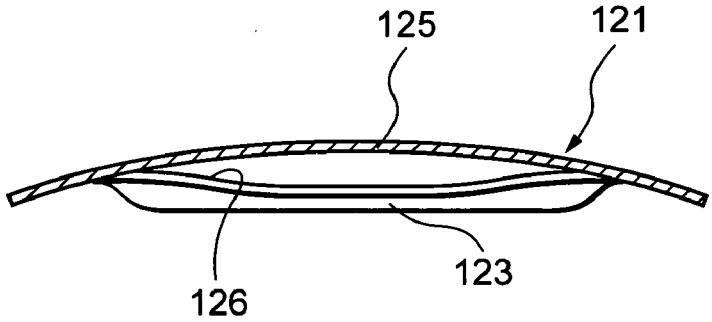

As illustrated in FIGS. 1, 4 and 5, there is also a first contact spring 121, positioned above the adhesive sheet 115. As also illustrated in FIG. 7, the first contact spring 121 is substantially in a dome shape, protruding in the upward direction of FIG. 1. The both ends at the outer periphery of the first contact spring 121, facing opposite to each other, have been formed in bowing shapes, serving as outer peripheral contacts 123, 123. As illustrated in FIG. 5, the outer peripheral contacts 123, 123 are in regular contact with the first fixed contacts 103, 103, via the openings 119, 119 of the adhesive sheet 115, and via the openings 111*b*, 111*b* of the adhesive sheet 109.

There is an inner contact 125 at the center of the first contact spring 121. As illustrated in FIGS. 4 and 5, the inner contact 125 is reversed by depressing operation, and becomes in contact with the inner contact 113*b* of the second contact spring 113, via the circular opening 117 of the adhesive sheet 115. This is a first-stage motion, whereby a first electric circuit (not shown) is actuated. When the inner contact 125 is further depressed, the second contact spring 113 is then reversed, whereby the reverse side of the inner contact 113*b* of the second contact spring 113 becomes in contact with the third fixed contact 107 of the circuit board 101. Thus, a second electric circuit (not shown) is actuated.

For reference, the inner contact 125 is formed in a shape of bridge, and openings 126, 126 are formed on the both sides of the inner contact 125.

There is a spacer 127 above the first contact spring 121, and there is also a cover film 129 provided above the spacer 127. The spacer 127 has a circular opening 131. The cover film 129 serves as a dust prevention cover. The spacer 127 also has penetrating holes 128, 128, at positions diametrically opposite to each other, into which the fixing screws (not shown) are inserted respectively. Similarly, the cover film 129 has penetrating holes 130, 130, into which the fixing screws (not shown) are inserted.

Figure 8:
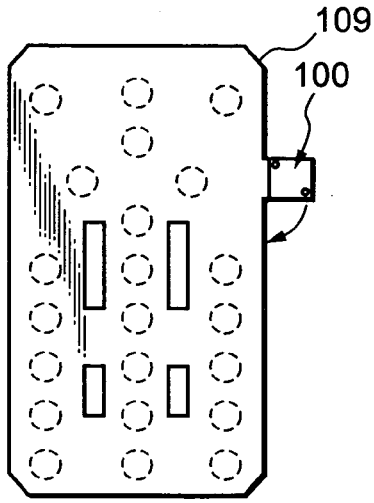
FIG. 8 is a plan view of a circuit board for portable telephone according to the first embodiment of the present invention.

Now an example of actual use of the two-step switch as discussed above, will be explained with reference to FIGS. 8 and 9. FIG. 8 is a plan view of a printed circuit board and adjacent structure for a portable telephone, and FIG. 9 is an exploded perspective view of the printed circuit board and adjacent structure for the portable telephone.

Figure 9:
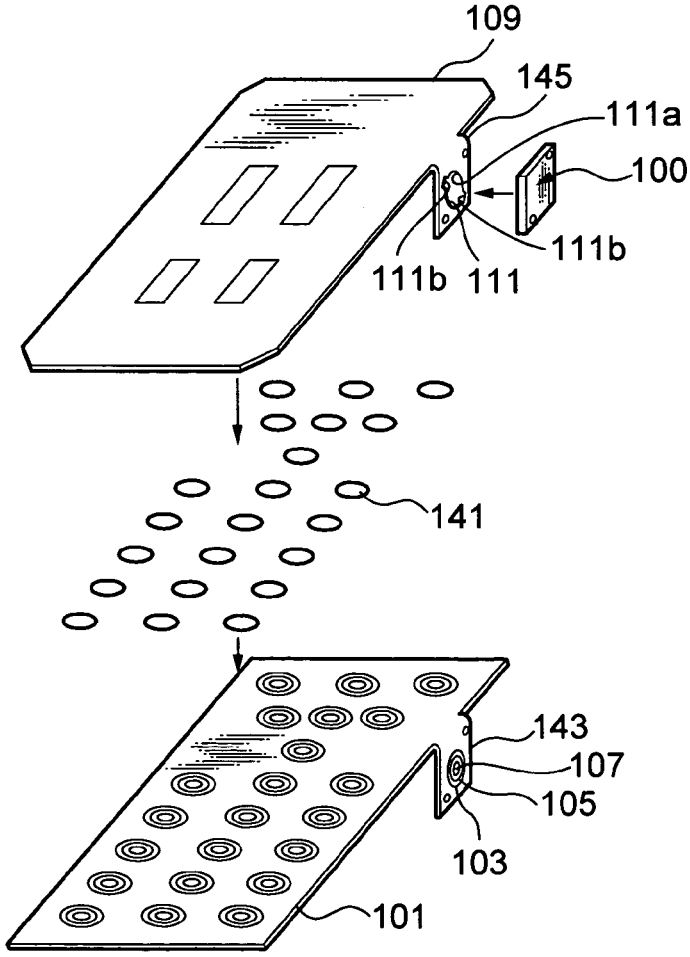
FIG. 9 is an exploded perspective view of the circuit board for portable telephone according to the first embodiment of the present invention.

As illustrated in FIG. 9, there is the printed circuit board 101, and dome contacts 141 are provided above the printed circuit board 101. There is an adhesive tape 109 above the dome contacts 141.

The printed circuit board 101 and the adhesive tape 109 respectively have bent parts 143, 145, so that these bent parts 143, 145 are stacked and bent at right angle. These bent parts serve as a side surface part of a portable telephone (not shown). The two-step switch as discussed above is provided at these bent parts.

The bent part 143 has the first fixed contacts 103, the second fixed contact 105 and the third fixed contact 107, as explained in FIG. 1. Further, the other bent part 145 of the adhesive tape 109 has the opening 111.

The first embodiment as discussed above has the following merits.

First, it is possible to reduce the size of the two-step switch, in particular, to reduce the size in radial direction. This is because, the present invention does not have a double structure of the first contact and the second contact in radial direction likewise the prior art, but has a structure in which the first contact spring 121 and the second contact spring 113 are stacked in perpendicular direction, whereby the size in radial direction will not be increased.

In particular, with reference to a portable telephone as an example, the thickness has been reduced, thus the size of the side surface should be minimized. As the size in radial direction of the two-step switch according to the prior art is large, it is quite difficult to incorporate the conventional two-step switch in such a narrow space. On the other hand, according to the two-step switch of the present invention, because the size in radial direction is reduced, it is possible to be incorporated in such a narrow space easily.

The first contact spring 121 and the second contact spring 113 are provided separately. Thus, it is not necessary to provide, likewise the case of the prior art, two different loading characteristics by a single contact spring. Therefore, the complicated adjustment working is no more required.

According to the present embodiment, the first contact spring 121 has an improved shape, whereby the necessary stroke may be secured. In particular, the parts in which the outer peripheral contacts 123, 123 are provided, are formed in bowing shapes toward the lower side, and the inner contact 125 is protrusively formed in a bridge shape, thus it is possible to secure the height, i.e., the stroke. Consequently, the different levels are no more required on the fixed contacts of the printed circuit board, i.e., the first fixed contacts 103, the second fixed contact 105 and the third fixed contact 107, and it is possible to cope with the printed circuit board 101 in various shapes easily.

Further, the cover film 129 may serve as the dust prevention cover.

Second Embodiment

Figure 10A:
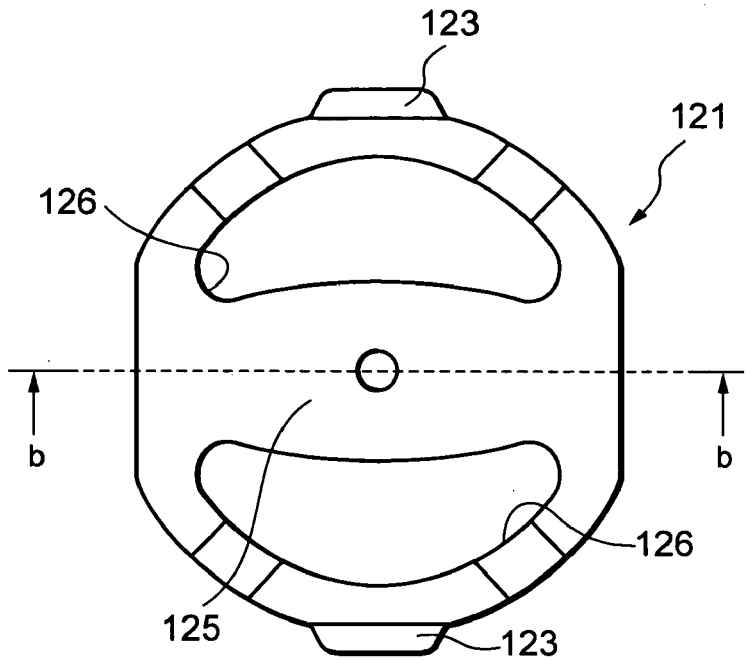
FIG. 10 has views showing a second embodiment of the present invention, in which, FIG. 10(*a*) is a plan view of a first contact spring, and FIG. 10(*b*) is a sectional view as seen by the line b—b of FIG. 10(*a*)
Figure 10B:
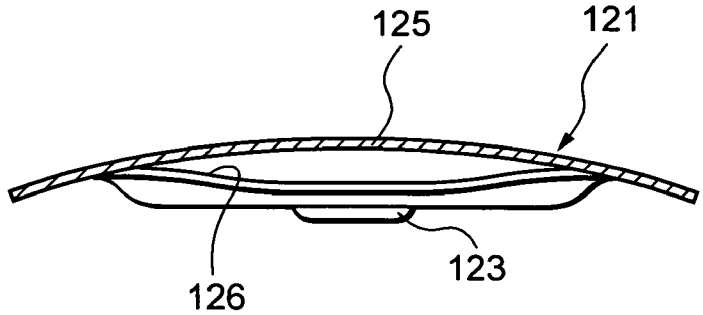

A second embodiment of the present invention will now be described with reference to FIG. 10. According to the second embodiment, the both ends of the first contact spring 121 according to the first embodiment are formed in bowing shapes toward the lower side, at which projecting chips are provided, respectively serving as the outer peripheral contacts 123, 123. As illustrated in FIG. 10, the outer peripheral contacts 123, 123 project, not only in radial direction, but also toward the opposite side of the protruding part. Thus, it is further possible to secure the height, in particular the stroke.

The other structure is substantially the same as that of the first embodiment, so the identical reference numerals are given to the identical parts, and the detailed explanation will not be done here.

Third Embodiment

Figure 11:
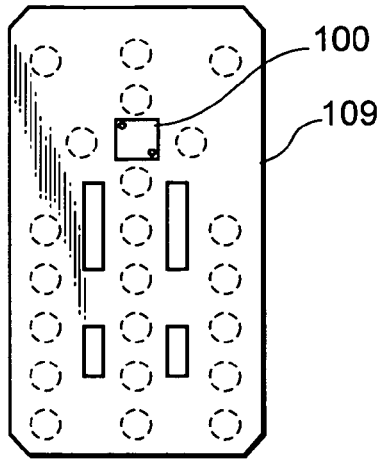
FIG. 11 is a plan view of a circuit board for portable telephone according to a third embodiment of the present invention.
Figure 12:
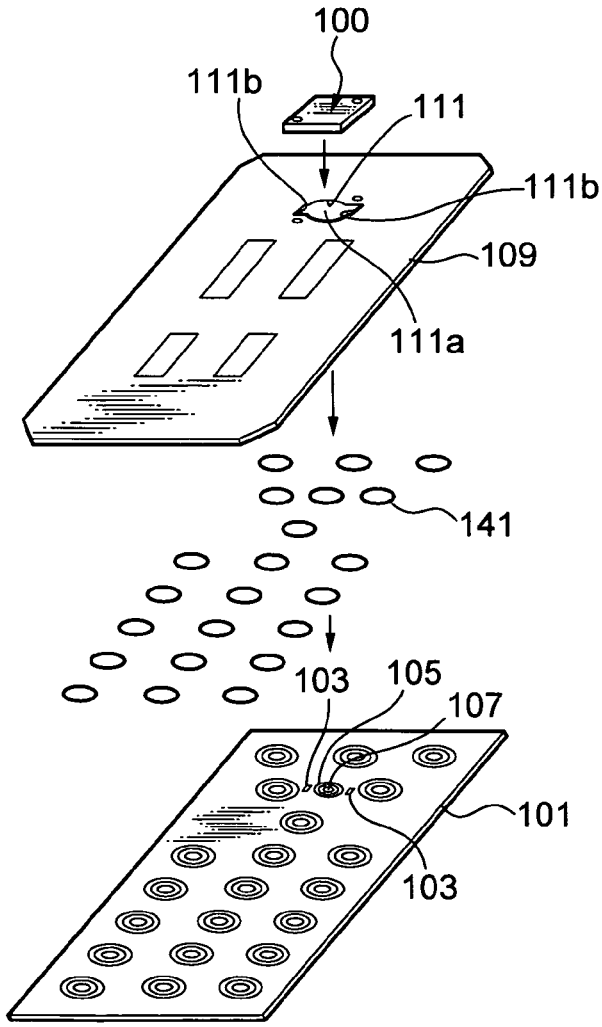
FIG. 12 is an exploded perspective view of the circuit board for portable telephone according to the third embodiment of the present invention.

A third embodiment of the present invention will now be described with reference to FIGS. 11 and 12. According to the first and second embodiments, as an example, the two-step switch is positioned on the side surface of the portable telephone. However, the present invention is not limited to that example.

According to the third embodiment, the two-step switch is positioned at the upper part of the front surface of a portable telephone. According to the third embodiment, it is also possible to obtain substantially the same effect as those of the first and second embodiments.

The other structure is substantially the same as that of the first and second embodiments, so the identical reference numerals are given to the identical parts, and the detailed explanation will not be done here.

Fourth Embodiment

Figure 13:
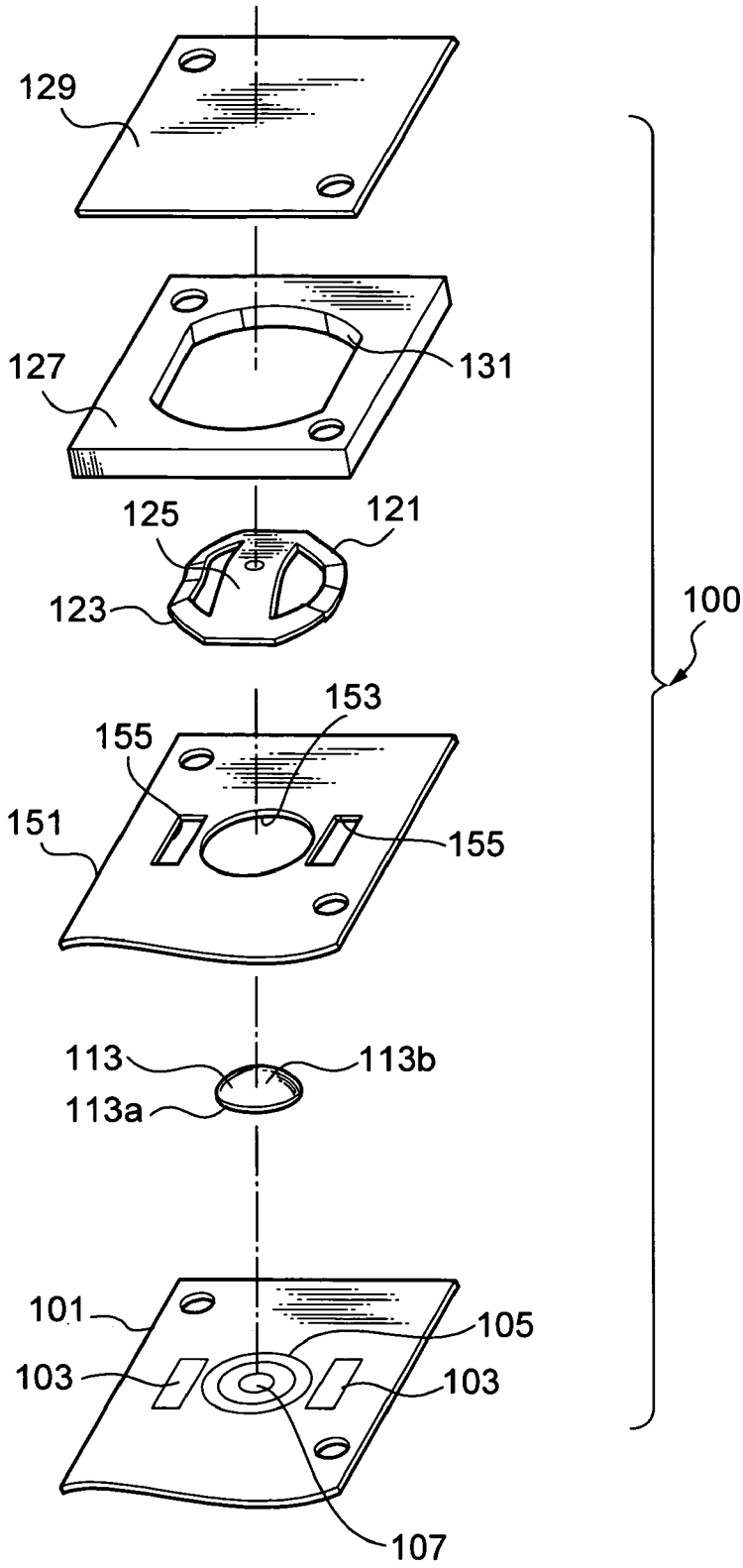
FIG. 13 is an exploded perspective view showing a structure of a two-step switch according to a fourth embodiment of the present invention.
Figure 14:
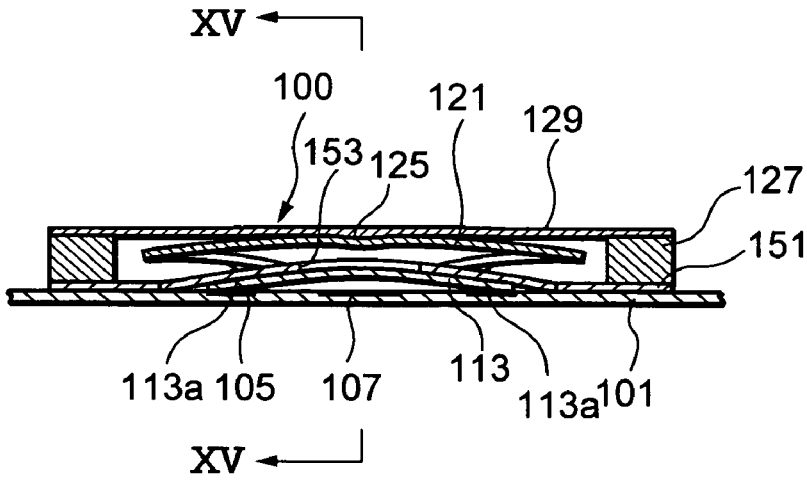
FIG. 14 is a sectional view of the two-step switch according to the fourth embodiment of the present invention.
Figure 15:
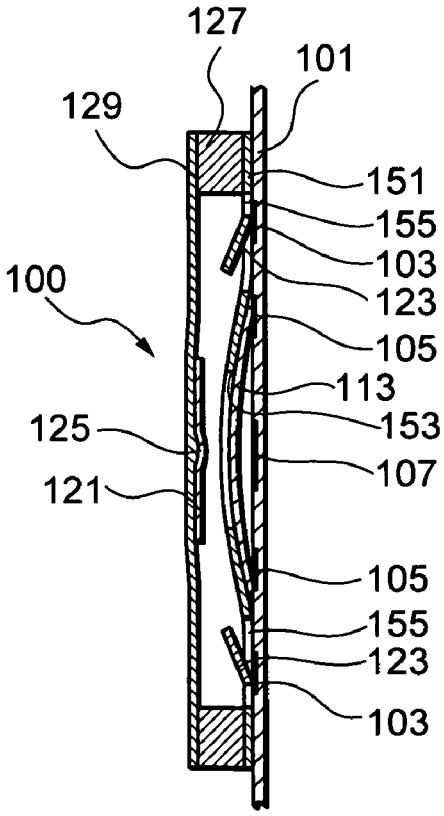
FIG. 15 is a sectional view as seen by the line XV—XV of FIG. 14 according to the fourth embodiment of the present invention.

A fourth embodiment of the present invention will now be described with reference to FIGS. 13 through 15. According to the fourth embodiment, the adhesive sheet 109 serving as the second insulation sheet in the first embodiment, has been removed, and only the adhesive sheet 151 serving as the first insulation sheet is provided. The shape of the adhesive sheet 151 is substantially the same as that of the adhesive sheet 109 of the first embodiment.

Accordingly, the adhesive sheet 151 has a circular opening 153, and a pair of rectangular openings 155, 155 are formed at the outside of the circular opening 151. FIG. 14 and FIG. 15 respectively show the sectional views of the two-step switch having the above structure.

The other structure is substantially the same as that of the first embodiment, so the identical reference numerals are given to the identical parts, and the detailed explanation will not be done here.

According to the fourth embodiment, it is also possible to obtain substantially the same effect as that of the first embodiment. Further, the number of parts regarding the second insulation sheet may be reduced, whereby the facile manufacturing and assembly work may be accomplished, and the production cost may be reduced.

Fifth Embodiment

Figure 16:
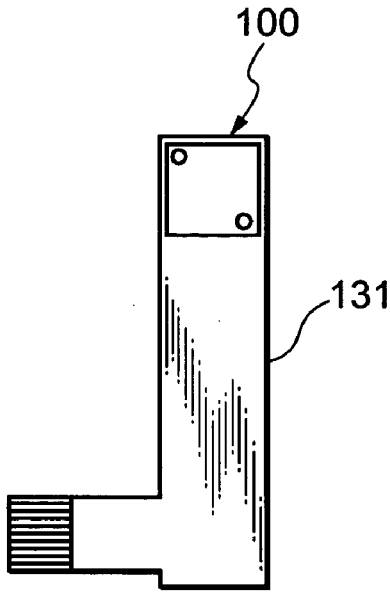
FIG. 16 is a plan view according to a fifth embodiment of the present invention, in which a two-step switch is attached to a circuit board.
Figure 17:
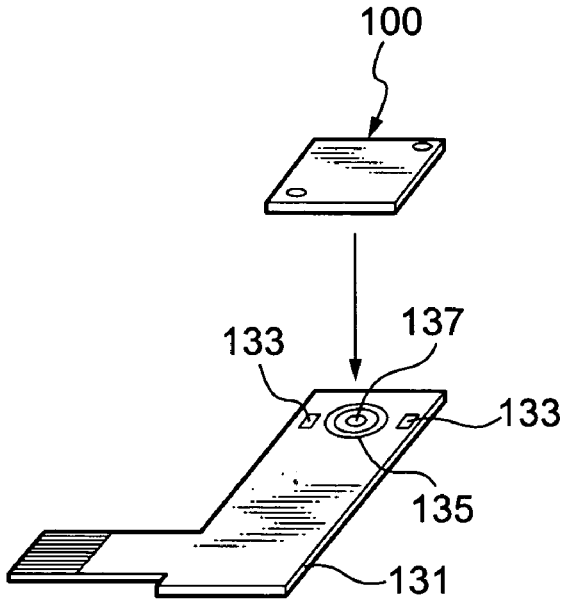
FIG. 17 is an exploded perspective view according to the fifth embodiment of the present invention, in which the two-step switch is attached to the circuit board.
Figure 18:
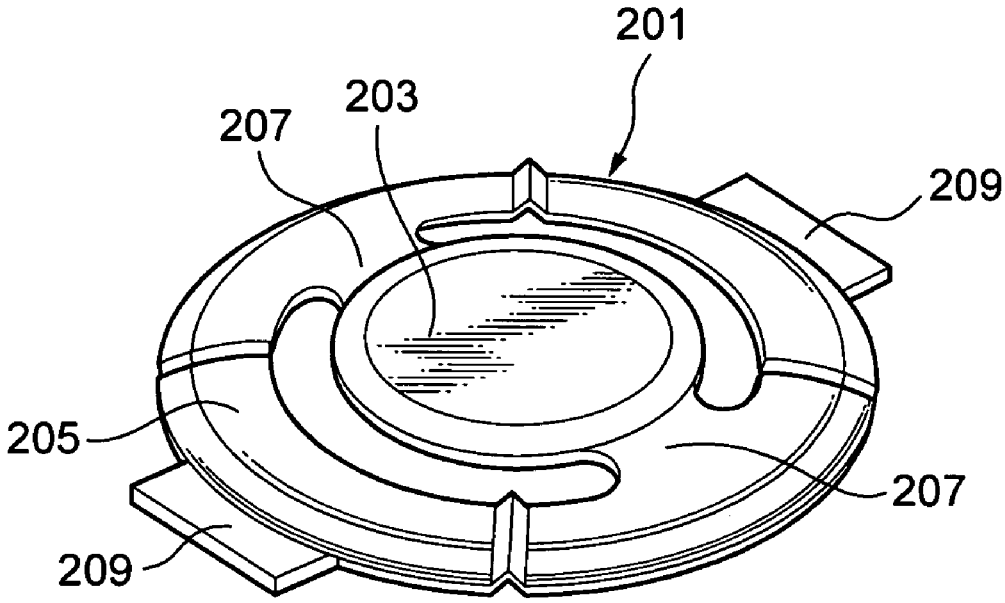
FIG. 18 is a perspective view showing a structure of a switch contact spring according to a prior art.

A fifth embodiment of the present invention will now be described with reference to FIGS. 16 and 17. There is a circuit board 131, and as illustrated in FIG. 17, the circuit board 131 is provided with fixed contacts 133, 135, 137, to which a two-step switch 100 is attached. According to the fifth embodiment, it is also possible to obtain substantially the same effect as that of the first through fourth embodiments.

The present invention is not limited to the first through fifth embodiments as discussed above, and any modification may be done without departing the spirit of the present invention.

The first through fifth embodiments have been discussed with regard to the two-step switch mounted on the printed circuit of the portable telephone, as an example, but the present invention is not limited to the portable telephone. The present invention can be applied to various circuit boards, for example, the circuit boards for various electric instruments and apparatus, electronic instruments and apparatus (e.g. digital cameras).

Further, the shape of each element is merely an example, and various shape and size may be utilized.

What is claimed is:

1. A two-step switch, comprising:

a circuit board having first fixed contacts, a second fixed contact and a third fixed contact;

a first contact spring, having outer peripheral contacts which are in regular contact with said first fixed contacts of said circuit board, and also having an inner contact which is positioned inside of said outer peripheral contacts and is reversed by depressing operation; and a second contact spring, stacked on said first contact spring via a first insulation sheet, having an outer peripheral contact which is in regular contact with said second fixed contact of said circuit board, and also having an inner contact which is positioned inside of said outer peripheral contact and is reversed by depressing operation, characterized in that:

said inner contact of said first contact spring is reversed by a first depressing operation, and becomes in contact with said inner contact of said second contact spring whereby a first electric circuit is actuated; and said inner contact of said second contact spring is reversed by a further second depressing operation, and becomes in contact with said third fixed contact of said circuit board, whereby a second electric circuit is actuated.

2. The two-step switch as claimed in claim 1, further characterized in that:

said first insulation sheet has an inner opening and outer openings, whereby said inner contact of said first contact spring becomes in contact with said inner contact of said second contact spring via said inner opening, and said outer peripheral contacts of said first contact spring are in contact with said first fixed contacts via said outer openings.

3. The two-step switch as claimed in claim 2, further characterized in that:

said first contact spring is covered by a cover film via a spacer.

4. The two-step switch as claimed in claim 2, further characterized in that:

said two-step switch is mounted on a circuit board of various electric and electronic instruments and apparatus.

5. The two-step switch as claimed in claim 1, further characterized in that:

said first contact spring is in a dome shape, of which both ends of outer peripheral parts opposing to each other serve as said outer peripheral contacts, and of which protruding part having said inner contact has been formed in a bridge shape having openings formed on both sides, and said both ends of said outer peripheral parts have been formed in bowing shapes toward the opposite side of said protruding part.

6. The two-step switch as claimed in claim 5, further characterized in that:

said both ends of said outer peripheral parts have projecting chips formed and projecting in radial direction and toward the opposite side of said protruding part, and said projecting chips serve as said outer peripheral contacts.

7. The two-step switch as claimed in claim 6, further characterized in that:

said first contact spring is covered by a cover film via a spacer.

8. The two-step switch as claimed in claim 6, further characterized in that:

said two-step switch is mounted on a circuit board of various electric and electronic instruments and apparatus.

9. The two-step switch as claimed in claim 5, further characterized in that:

said first contact spring is covered by a cover film via a spacer.

10. The two-step switch as claimed in claim 5, further characterized in that:

said two-step switch is mounted on a circuit board of various electric and electronic instruments and apparatus.

11. The two-step switch as claimed in claim 1, further characterized in that:

said second contact spring is in a dome shape, of which outer peripheral part serves as said outer peripheral contact, and of which protruding part serves as said inner contact.

12. The two-step switch as claimed in claim 11, further characterized in that:

said first contact spring is covered by a cover film via a spacer.

13. The two-step switch as claimed in claim 11, further characterized in that:

said two-step switch is mounted on a circuit board of various electric and electronic instruments and apparatus.

14. The two-step switch as claimed in claim 1, further comprising:

a second insulation sheet between said second contact spring and said circuit board.

15. The two-step switch as claimed in claim 14, further characterized in that:

said second insulation sheet has an inner opening and outer openings, whereby said outer peripheral contact of said second contact spring becomes in contact with said second fixed contact of said circuit board via said inner opening, and said outer peripheral contacts of said first contact spring are in contact with said first fixed contacts via said outer openings.

16. The two-step switch as claimed in claim 15, further characterized in that:

said first contact spring is covered by a cover film via a spacer.

17. The two-step switch as claimed in claim 14, further characterized in that:

said first contact spring is covered by a cover film via a spacer.

18. The two-step switch as claimed in claim 1, further characterized in that:

said first contact spring is covered by a cover film via a spacer.

19. The two-step switch as claimed in claim 1, further characterized in that:

said two-step switch is mounted on a circuit board of various electric and electronic instruments and apparatus.

20. The two-step switch as claimed in claim 1, further characterized in that:

said two-step switch is mounted on a circuit board of a portable telephone.

* * * * *